US005692102A

United States Patent [19]

Pan

[11] Patent Number: 5,692,102

[45] Date of Patent: Nov. 25, 1997

[54] METHOD DEVICE AND SYSTEM FOR AN EFFICIENT NOISE INJECTION PROCESS FOR LOW BITRATE AUDIO COMPRESSION

[75] Inventor: Davis Pan, Buffalo Grove, Ill.

[73] Assignee: Motorola, Inc., Schaumburg, Ill.

[21] Appl. No.: 548,773

[22] Filed: Oct. 26, 1995

[51] Int. Cl.[6] ..... G10L 7/00

[52] U.S. Cl. ..... 395/2.39

[58] Field of Search ..... 395/2.35, 2.39, 395/2.92; 381/41–53

[56] References Cited

U.S. PATENT DOCUMENTS

| | | | |
|---|---|---|---|
| 4,896,362 | 1/1990 | Veldhuis et al. | 381/30 |
| 4,956,871 | 9/1990 | Swaminathan | 381/31 |
| 5,185,800 | 2/1993 | Mahieux | 381/29 |
| 5,222,189 | 6/1993 | Fielder | 395/2 |
| 5,533,052 | 7/1996 | Bhaskar | 375/244 |
| 5,553,193 | 9/1996 | Akagiri | 395/2.38 |

OTHER PUBLICATIONS

Parsons; Voice and Speech Processing; Chapter 9, "Speech compression;" McGraw–Hill, Inc.; pp. 228–229, 1987.

*Primary Examiner*—Allen R. MacDonald
*Assistant Examiner*—Susan Wieland
*Attorney, Agent, or Firm*—Darleen J. Stockley

[57] ABSTRACT

The present invention provides a device, method and system of noise injection to maximize compressed audio quality while enabling bitrate scalability. It includes at least one of an encoder and a decoder. The encoder includes a zero detection unit, coupled to receive a frequency domain quantized signal, for determining a control signal that indicates whether noise injection is implemented and a normalization computation unit, coupled to receive at least unquantized signal values and the control signal, for determining a normalization term in accordance with the control signal. The decoder includes a zero detection unit, coupled to receive a frequency domain quantized signal, for determining a control signal that indicates when noise injection is active and a noise generation and normalization unit, coupled to receive a normalization term and the control signal, for generating, normalizing, and injecting a predetermined noise signal where indicated by the control signal.

10 Claims, 4 Drawing Sheets

400

METHOD DEVICE AND SYSTEM FOR AN EFFICIENT NOISE INJECTION PROCESS FOR LOW BITRATE AUDIO COMPRESSION

1. Field of the Invention

The present invention relates to high quality generic audio compression, and more particularly, to high quality generic audio compression at low bit rates.

2. Background

Modern, high-quality, generic, audio compression algorithms take advantage of the noise masking characteristics of the human auditory system to compress audio data without causing perceptible distortions in the reconstructed audio signal. This form of compression is also known as perceptual coding. Most algorithms code a predetermined, fixed, number of time-domain audio samples, a 'frame' of data, at a time. Since the noise masking properties depend on frequency, the first step of a perceptual coder is to map a frame of audio data to the frequency domain. The output of this time-to-frequency mapping process is a frequency domain signal where the signal components are grouped according to subbands of frequency. A psychoacoustic model analyzes the signal to determine both the signal-dependent and signal-independent noise masking characteristics as a function of frequency. These masking characteristics are expressed as signal-to-mask ratios for each subband of frequency. A quantizer can then use these ratios to determine how to quantize the signal components within each subband such that the quantization noise will be inaudible. Quantizing the signal in this manner reduces the number of bits needed to represent the audio signal without necessarily degrading the perceived audio quality of the resulting signal.

As long as there are enough code bits to guarantee that the quantization noise will be less than the noise masking level within each subband, the coding process will not produce audible distortions. In the case of very low bitrate coding of audio signals, this will usually not be the case. Under these conditions, the quantizer attempts to mask as much of the quantization noise as possible based on the signal-to-mask ratios computed by the psychoacoustic model. Sometimes this causes the quantizer to alternately quantize certain subbands to all zeroes, then quantize the same subbands to non-zero values from one frame of data to the next. This alternating turn-on and turn off of subbands produces very unnatural swishing or warbling artifact sounds.

Bitrate scalability is a useful feature for data compression coder and decoders. A scalable coder encodes a signal at a high bitrate so that subsets of this bitstream can be decoded at lower bitrates. One application of this feature is the remote browsing of data without the burden of downloading the full, high bitrate data file. For the efficient use of code bits, the low bitrate streams should be used to help reconstruct the higher bitrate streams. One approach is to first encode data at a lowest supported bitrate, then encode an error between the original signal and a decoded lowest bitrate signal to form a second lowest bitrate bitstream and so on. For this scheme to work, the error signal must be easier to compress than the original. For this to be the case, the signal-to-noise ratio of each decoded output should be maximized. This is not the case for most noise shaping techniques used in speech coding.

Thus, there is a need for a device, method and system that provides an efficient method of improving the quality of compressed audio signals by masking the unnatural swishing artifacts, and where selected, by facilitating scalable bitrate coding.

BRIEF DESCRIPTIONS OF THE DRAWINGS

DETAILED DESCRIPTION OF A PREFERRED EMBODIMENT

The present invention provides a novel device, method and system for noise injection into a compressed audio signal. This invention improves the audio quality of highly compressed audio data by reducing the audibility of artificial sounding compression artifacts. These artifacts are caused by alternately turning on and off frequency subbands.

Alternative approaches, as the approach described in U.S. patent application Ser. No. 08/207,995 by James Fiocca et al., incorporated herein by reference, may either reduce the bandwidth of the compressed audio signal or increase the audibility of noise in other parts of the spectrum. The present invention offers these improvements with a very low coding overhead. In one implementation of the present invention, only 4 bits of overhead code are needed per frame (1024 samples) of audio data. The invention has an additional advantage in that it does not adversely affect the signal-to-noise ratio of the coded signal. This is advantageous for bitrate scalable coding. Noise can be injected at the last stage of decoding. Pre-noise-injected versions of the decoded signals can be summed together to build the highest-bitrate, highest-fidelity, version of the decoded signal.

Figure 1:
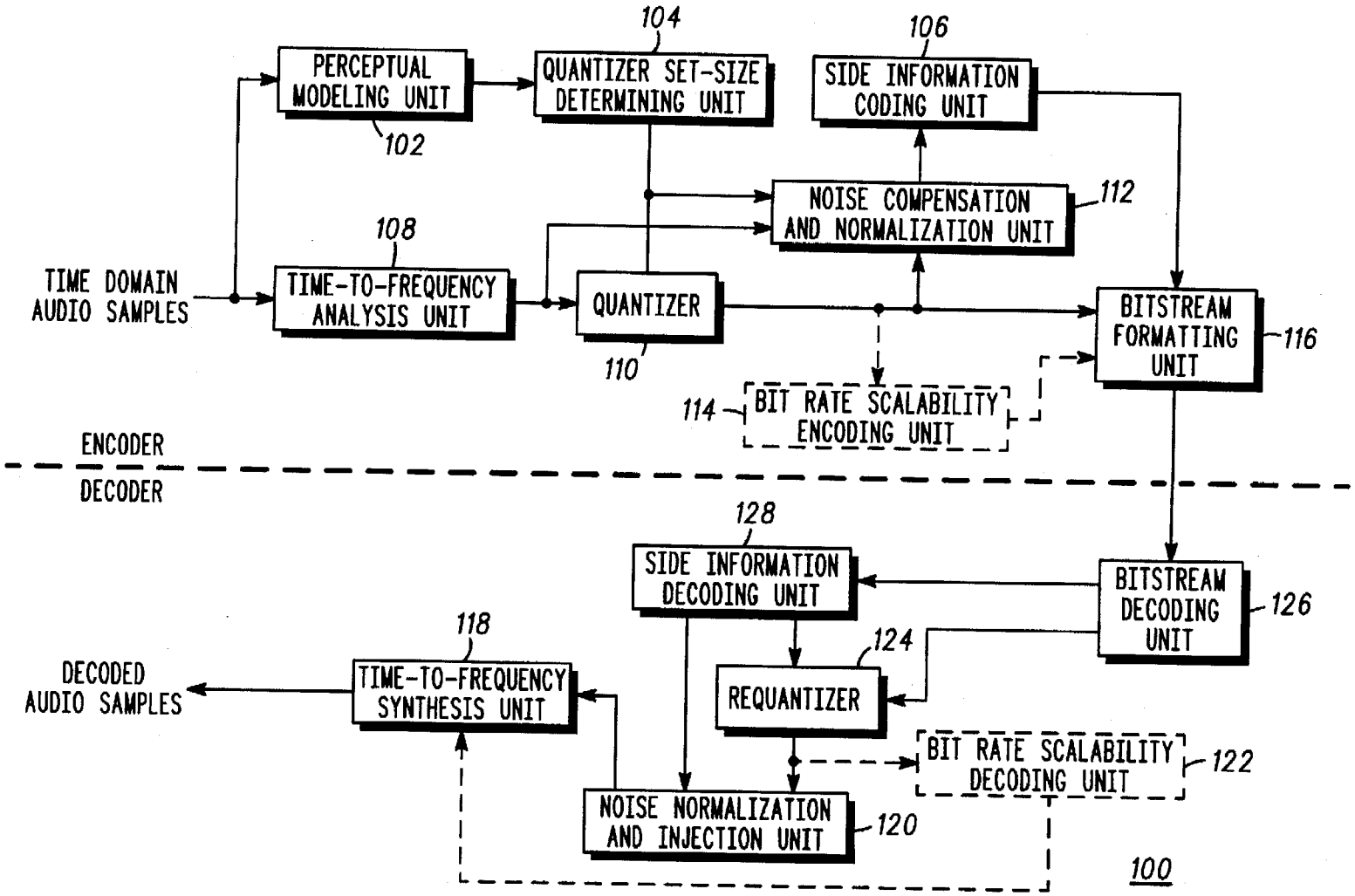
FIG. 1 is a block diagram of one embodiment of an audio compression system that utilizes an encoder and a decoder in accordance with the present invention.
Figure 4:
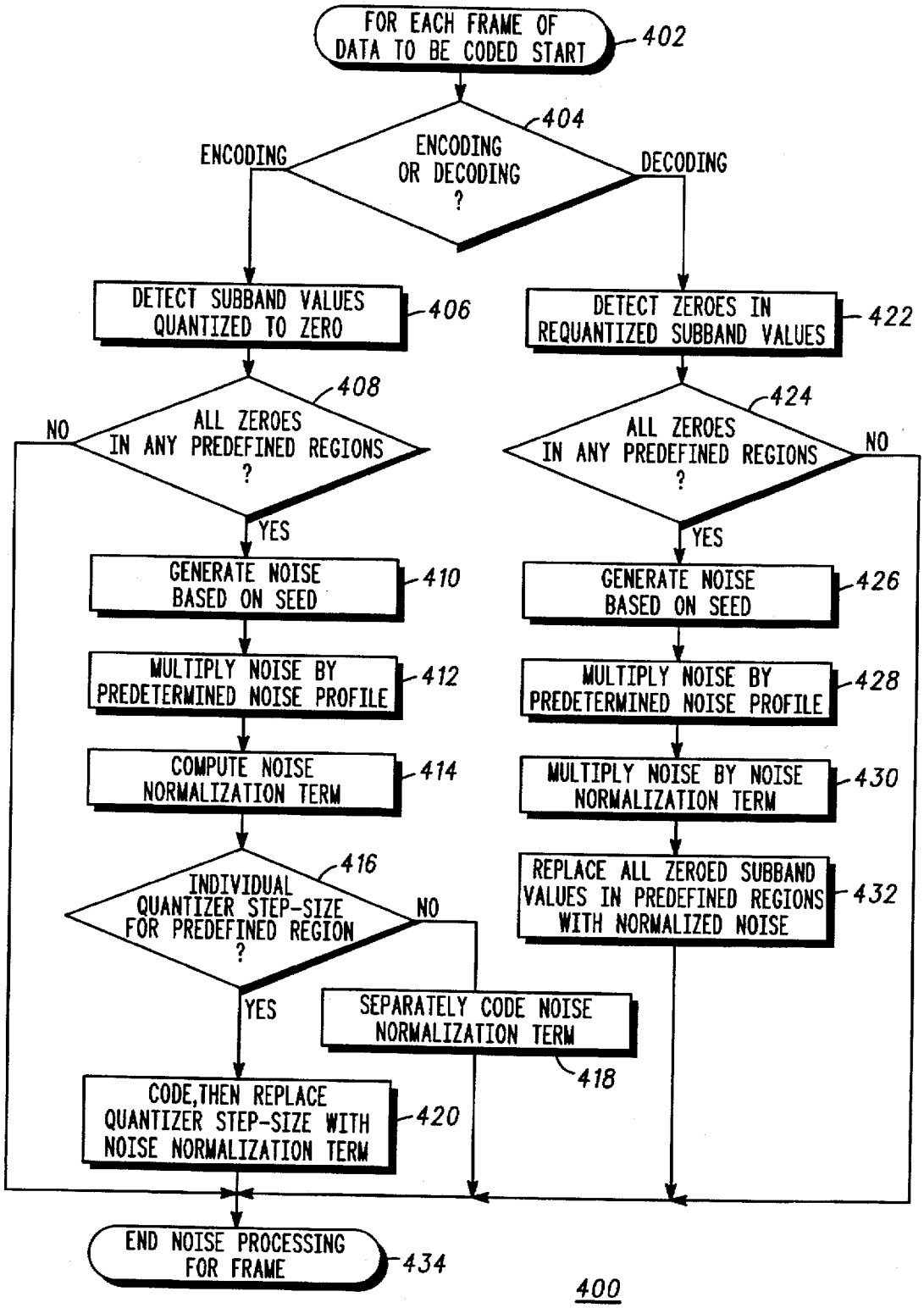
FIG. 4 is a flow chart of steps for a preferred embodiment of steps of a method in accordance with the present invention.
Figure 5:
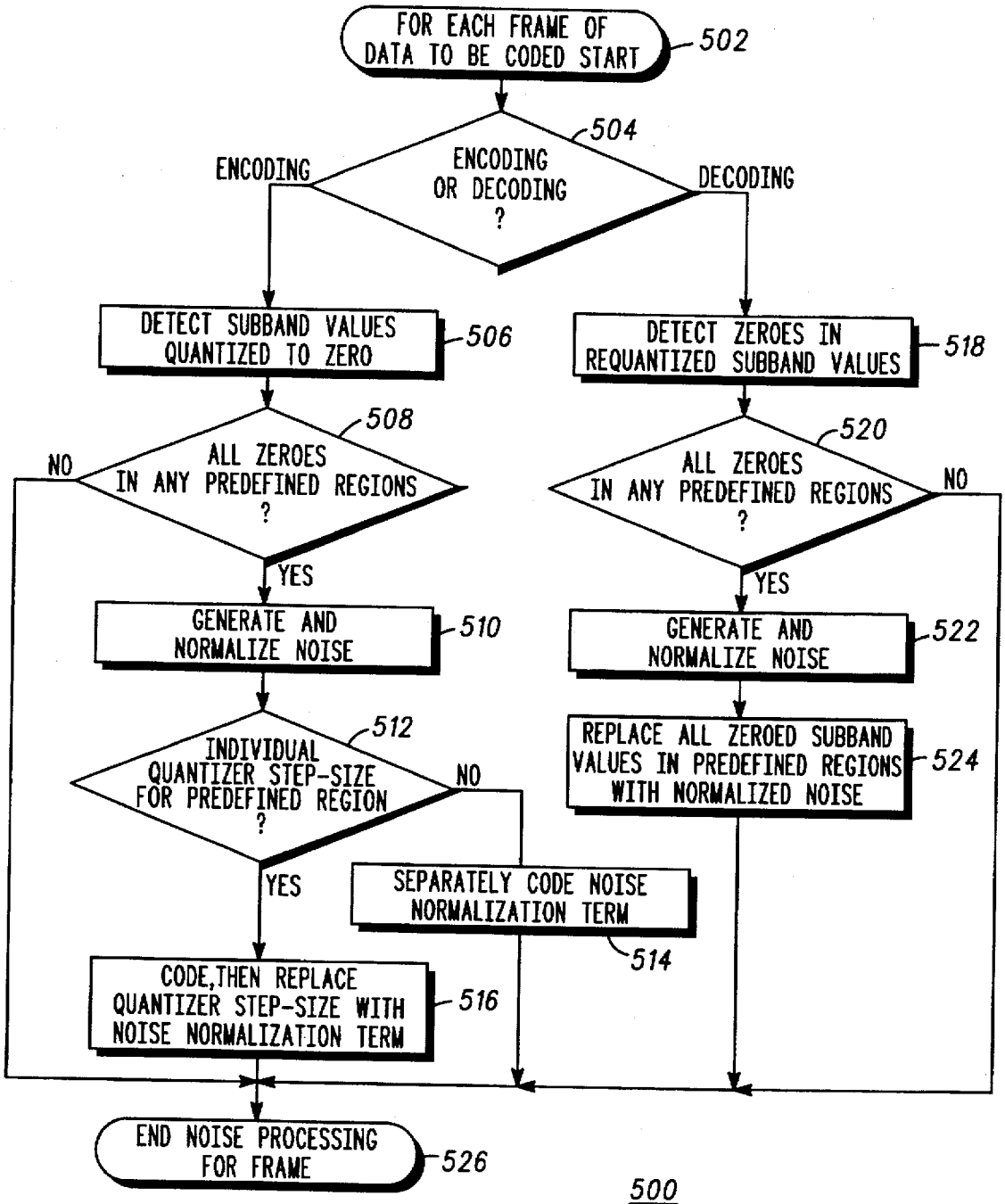
FIG. 5 is a flow chart of steps for another preferred embodiment of steps of a method in accordance with the present invention.

FIG. 1, numeral 100, is a block diagram of one embodiment of an audio compression system that utilizes at least one of an encoder and a decoder in accordance with the present invention. FIG. 4 , numeral 400, is a flow chart of steps for a preferred embodiment of steps of a method in accordance with the present invention. FIG. 5, numeral 500, is a flow chart of steps for another preferred embodiment of steps of a method in accordance with the present invention.

Different noise injection processing is used in the encoder and the decoder (404, 504).

Figure 2:
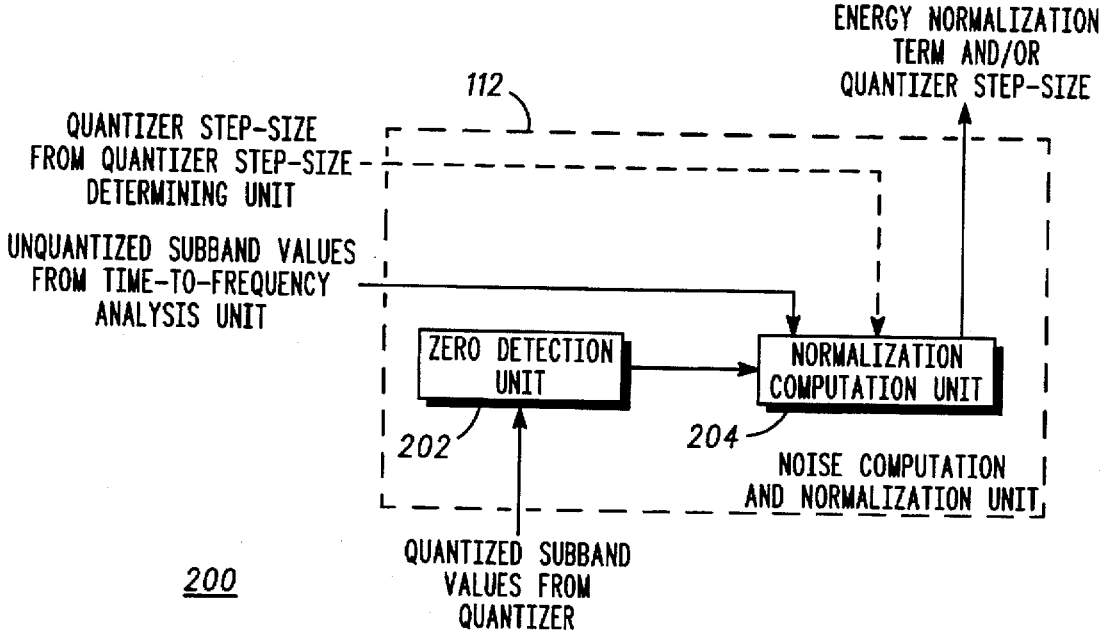
FIG. 2 is a block diagram of one embodiment of a noise computation and normalization unit of the encoder of FIG. 1 shown with greater particularity.

The encoder includes a noise computation and normalization unit (112). FIG. 2, numeral 200, is a block diagram of one embodiment of a noise computation and normalization unit shown with greater particularity. The noise computation and normalization unit consists of: A) a zero detection unit (202) that is coupled to receive a frequency domain quantized signal, and is used for determining, a control signal that indicates whether noise injection is implemented in accordance with a predetermined scheme; B) a normalization computation unit (204) that is coupled to receive at least unquantized subband values and the control signal from the zero detection unit, and is used for determining an energy normalization term based on the unquantized subband values in accordance with the control signal.

During encoding, audio data is processed by a time-to-frequency analysis unit (108) a frame of samples at a time (402, 502). The time-to-frequency analysis unit maps time domain audio samples to a frequency domain. The frame of audio samples is also processed simultaneously by a perceptual modeling unit (102). The perceptual modeling unit computes a signal-to-mask ratio for each subband of frequency. A quantizer step-size determining unit (104) uses these ratios to determine a quantizer step-size for each subband of frequency. A quantizer (110) quantizes the frequency domain samples using the computed step-sizes. A noise computation and normalization unit (112) evaluates quantized subband values from the quantizer to determine if a noise signal is to be injected (202) and computes a normalization term. The normalization term scales the injected noise.

In order to produce more subjectively pleasing noise injected sounds, the injected noise may be colored by a predetermined noise energy profile (412, 428). A linearly decreasing ramp profile:

profiled_noise(f)=noise(f)*[HIGHLIM—f]/[HIGHLIM—LOWLIM] provides acceptable results. HIGHLIM and LOWLIM are predetermined constants. For example, values of HIGHLIM equal to 145 and LOWLIM of zero are appropriate for coding at six kilobits per second with a frame size of 1024.

In order to have accurate values for the noise normalization term, the noise values injected at the encoder should be the same as the noise values injected at a decoder. For this to be the case, identical random noise generators should be used at the encoder and decoder and seeds for the generators should be the same (410, 426). In one embodiment, an audio frame number (computed within blocks 204 and 304) is used to seed the random noise generators for each frame. Other seeds available to both the encoder and decoder, such as code bits within the code bitstream representing the frame of data, may be used.

The method of noise generation by seeding and noise coloring with a noise profile may be omitted, where selected, from embodiments of the invention (510, 520).

The invention accommodates a predetermined audio compression scheme that includes using one of two implementations of the audio compression system. One implementation codes an individual quantizer step-size for each predefined frequency region. The other implementation codes a single global step-size for the entire frame. The invention accommodates both implementations of the audio compression system by checking (416, 512).

In the audio compression system where there is a quantizer step-size for each of several pre-determined subbands of frequency, the zero detection unit (202) detects when all values of a subband are quantized to zero (406, 506) and generates a control signal indicating whether there are all zeros in any pre-defined regions (408, 508). If all predefined regions contain non-zero values,. the noise processing is ended for the frame (434, 526), otherwise a normalization term replaces the quantizer step-size for each subband that was quantized to all zeroes (420, 516). The normalization term is based on a ratio of a sum energy of the unquantized frequency domain samples within a predetermined subband that have all been quantized to zero and a sum energy of the injected noise (204,414,510).

In the audio compression system where there may be only one global quantizer step-size for the entire frame, the noise normalization term is coded in addition to the quantizer step-size (418, 514). Instead of detecting when all values of a subband are quantized to zero, the zero detection unit (202) detects whenever any frequency value in a frame of audio data gets quantized to zero (406, 506) and generates a control signal indicating whether there are any zeros in the frame (408, 508). If the frame contains only non-zero values, the noise processing is ended for the frame (434, 526). The noise normalization term is based on a ratio of a sum energy of all of the unquantized frequency domain samples within the frame that were quantized to zero and a sum energy of the injected noise (204, 414, 510). In this implementation there will be only one normalization term for each frame of audio samples.

To efficiently represent the noise normalization term with only a few code bits, a coded representation is sent to a side information coding unit (106, 418, 420, 514, 516). The coded representation of this term is equal to one half of the logarithm, base 2, of the one of the two ratios (depending on the implementation) described above. In mathematical terms, this may expressed as:

$$\text{Coded representation}=K \times \log_2 (\Sigma(x^2(n)/y^2(n)))$$

where:

n is the index of samples in the frame,

K is a constant, $x^2(n)$ is the original energy of the signal, samples that were quantized to zero, and $y^2(n)$ is the energy of the noise to be substituted for samples quantized to zero.

Side information is sent to a bitstream formatting unit (116) which also encodes the quantized frequency domain samples. This completes the noise injection processing for the frame of audio data (434, 526).

Since the quantized frequency domain samples are free of injected noise at the encoder, an optional bitrate scalability encoding unit (114) may directly use the quantized samples for difference coding.

Figure 3:
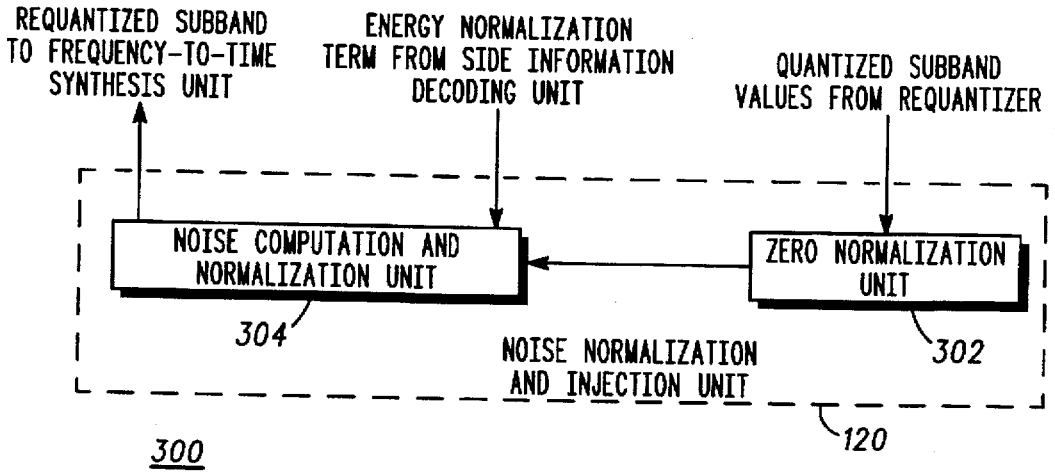
FIG. 3 is a block diagram of one embodiment of a noise normalization and injection unit of the decoder of FIG. 1 shown with greater particularity.

The decoder includes a noise normalization and injection unit (120). FIG. 3, numeral 300, is a block diagram of one embodiment of a noise normalization and injection unit shown with greater particularity. The noise normalization and injection unit consists of: A) a zero detection unit (302), coupled to receive a frequency domain quantized signal, for determining a control signal that indicates implementation of noise injection according to a predetermined scheme when values of the frequency domain quantized signal are zero; and B) a noise generation and normalization unit (304), coupled to receive the energy normalization term and the control signal from the zero detection unit, for substituting a predetermined noise signal multiplied by the energy normalization term where indicated by the control signal.

For decoding, a bitstream decoding unit (126) decodes the quantized frequency domain samples and sends the samples to a requantizer (124). The bitstream decoding unit also sends coded side information to a side information decoding unit (128). The side information decoding unit decodes a quantizer step-size and noise normalization term(s). The side information decoding unit sends the quantizer step-size to the requantizer (124) and the normalization term to a noise normalization and injection unit (120). The noise normalization and injection unit detects where the requantized frequency domain samples were quantized to zero (302) and injects noise according to a pre-determined scheme (304).

In audio compression systems where there is a quantizer step-size for each of several pre-determined subbands of frequency, the noise computation and normalization unit (304) injects noise only into the all-zeroed subbands (422, 424, 432, 518, 520, 524).

In audio compression systems where there is only one global quantizer step-size for the entire frame, the noise normalization term is coded in addition to the global quantizer step-size. There will be only one normalization term for each frame of audio samples. Instead of detecting when all values of a subband are quantized to zero, the zero detection unit (302, 422, 518) detects whenever any frequency value in the frame of audio data is quantized to zero (424, 520). The noise computation and normalization unit (304) injects noise to all of these zeroed values (432).

To decode the noise normalization term, the decoder multiplies the coded representation of the normalization term by a factor less than or equal to 2. The factor is set based on the perceived audio quantity and may be adjusted at the decoder. The product is raised to the second power to obtain the noise normalization term. The noise signal is generated with the random number generator and seed (426) as described above, then optionally colored (428) by the same pre-determined noise profile in the encoder and multiplied by the noise normalization term (430). The invention does not require noise generation based on a particular seed or noise coloring (522). The processed noise is injected into the quantized frequency domain samples that were quantized to zero (432, 524). These samples are sent to the time-to-frequency synthesis unit (118) for final decoding to time domain audio samples.

If selected, the requantized sample values may be used by a bitrate scalability decoding unit (122) before noise is injected by the noise normalization and injection unit (120). Thus the scalability unit accesses clean sample values with higher signal-to-noise ratio than the noise injected sample values. The clean sample values are accumulated for each successive higher bitrate before sending the result for the time-to-frequency synthesis unit (118).

The method and device of the present invention may be selected to be embodied in least one of: A) an application specific integrated circuit; B) a field programmable gate array; C) a microprocessor; and D) a computer-readable memory; arranged and configured for efficient noise injection for low bitrate audio compression to maximize audio quality in accordance with the scheme described in greater detail above.

I claim:

1. A system for efficient noise injection for low bitrate audio compression to maximize audio quality, wherein the system includes at least one of A–B;

A) the encoder including a noise substitution and normalization unit comprising:

1) an encoder zero detection unit, coupled to receive a frequency domain quantized signal, for determining a control signal that indicates whether noise injection is implemented in accordance with a predetermined audio compression scheme;

2) a normalization computation unit, coupled to receive at least unquantized subband values and the control signal from the encoder zero detection unit, for determining an energy normalization term based on the unquantized subband values when the control signal indicates all zero values for predefined regions;

B) the decoder including a noise normalization and injection unit comprising:

1) a decoder zero detection unit, coupled to receive a frequency domain quantized signal, for determining, a control signal that indicates implementation of noise injection is implemented in accordance with a predetermined audio compression scheme when values of the frequency domain quantized signal are zero; and 2) a noise generation and normalization unit, coupled to receive the energy normalization term and the control signal from the decoder zero detection unit, for substituting a predetermined noise signal multiplied by the energy normalization term where indicated by the control signal, wherein the predetermined audio compression scheme comprises one of A–B;

A) coding an individual quantizer step-size for each pre-defined frequency region; and B) coding a single global step-size for an entire frame of audio data.

2. A device for efficient noise injection for low bitrate audio compression to maximize audio quality, comprising: at least one of an encoder and a decoder:

A) the encoder including a noise computation and normalization unit comprising:

1) an encoder zero detection unit, coupled to receive a frequency domain quantized signal, for determining a control signal that indicates whether noise injection is implemented in accordance with a predetermined audio-compression scheme;

2) a normalization computation unit, coupled to receive at least unquantized subband values and the control signal from the encoder zero detection unit, for determining an energy normalization term based on the unquantized subband values when the control signal indicates all zero values for predefined regions;

B) the decoder including a noise normalization and injection unit comprising:

1) a decoder zero detection unit, coupled to receive a frequency domain quantized signal, for determining, a control signal that indicates implementation of noise injection according to the predetermined audio compression scheme when values of the frequency domain quantized signal are zero; and 2) a noise generation and normalization unit, coupled to receive the energy normalization term and the control signal from the decoder zero detection unit, for substituting a predetermined noise signal multiplied by the energy normalization term when the control signal indicates all zero values for predefined regions, wherein the predetermined audio compression scheme comprises one of A–B;

A) coding an individual quantizer step-size for each pre-defined frequency region; and B) coding a single global step-size for an entire frame of audio data.

3. The device of claim 1 wherein the noise normalization and injection unit in the decoder is utilized subsequent to bitrate scalability module/modules.

4. The device of claim 1 wherein, in the encoder, the input to the normalization computation unit further includes a quantization step size and the unit substitutes the energy normalization term for the quantizer step size value in accordance with the control signal.

5. The device of claim 1 wherein the device is embodied in least one of:

A) an application specific integrated circuit;

B) a field programmable gate array;

C) a microprocessor; and

D) a computer-readable memory;

arranged and configured for efficient noise injection for low bitrate audio compression to maximize audio quality in accordance with the scheme of claim 1.

6. A method for efficient noise injection for low bitrate audio compression to maximize audio quality, comprising the steps of at least one of A–B:

A) in an encoder, including the steps of:

1) determining, by an encoder zero detection unit, a control signal that indicates whether noise injection is implemented in accordance with a predetermined audio compression scheme;

2) determining, by a noise injection unit, an energy normalization term based at least on unquantized subband values when the control signal indicates all zero values for predefined regions;

B) in a decoder, the steps of:

1) determining, by a decoder zero detection unit, a control signal that indicates implementation of noise injection is implemented in accordance with the predetermined audio compression scheme when values of the frequency domain quantized signal are zero; and 2) substituting, by a noise injection unit, a predetermined noise signal multiplied by the energy normalization term where indicated by the control signal, wherein the predetermined audio compression scheme comprises one of A–B;

A) coding an individual quantizer step-size for each pre-defined frequency region; and B) coding a single global step-size for an entire frame of audio data.

7. The method of claim 6 wherein noise normalization and injection is implemented in the decoder subsequent to utilizing bitrate scalability module/modules.

8. The method of claim 6 further including, in the encoder, substituting an energy normalization term for a quantizer step size value where indicated by the control signal.

9. The method of claim 6 wherein the energy normalization term is determined in accordance with an equation of a form:

$$\text{Coded representation}=K * \log_2 (\Sigma(x^2(n)/y^2(n)))$$

where:

n is the index of samples in the frame,

K is a constant, $x^2(n)$ is the original energy of the signal samples that were quantized to zero, and $y^2(n)$ is the energy of the noise to be substituted for samples quantized to zero, wherein n ranges from 1 to N, with N=a number of frequency coefficients in one frame of frequency domain signal, and one of a first predetermined audio compression scheme and a second predetermined compression scheme, wherein:

for the first predetermined audio compression scheme, an energy normalization term is calculated for each predefined frequency region whose entire contents is quantized to zero, and for each normalization term, n ranges from a lowest index in the region to the highest index in the region; and for the second predetermined audio compression scheme, an energy normalization term is calculated once for the whole frame, and n consists only of indices from the set whose corresponding frequency coefficients are quantized to zero.

10. The method of claim 6 wherein the method is a process whose steps are embodied in least one of:

A) an application specific integrated circuit;

B) a field programmable gate array;

C) a microprocessor; and

D) a computer-readable memory;

arranged and configured for efficient noise injection for low bitrate audio compression to maximize audio quality in accordance with the scheme of claim 4.

* * * * *